US009792791B2

(12) United States Patent
Sankey

(10) Patent No.: US 9,792,791 B2
(45) **Date of Patent: *Oct. 17, 2017**

(54) COMBINATION NON-PROGRAMMABLE AND PROGRAMMABLE KEY FOR SECURITY DEVICE

(71) Applicant: InVue Security Products Inc., Charlotte, NC (US)

(72) Inventor: James K. Sankey, Charlotte, NC (US)

(73) Assignee: InVue Security Products Inc., Charlotte, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/057,630

(22) Filed: Mar. 1, 2016

(65) Prior Publication Data

US 2016/0180666 A1 Jun. 23, 2016

Related U.S. Application Data

(63) Continuation of application No. 14/454,111, filed on Aug. 7, 2014, now Pat. No. 9,305,444, which is a (Continued)

(51) Int. Cl.
*G08B 13/14* (2006.01)
*E05B 45/06* (2006.01)
(Continued)

(52) U.S. Cl.
CPC ..... *G08B 13/14* (2013.01); *E05B 19/046* (2013.01); *E05B 45/06* (2013.01); *E05B 47/004* (2013.01); *E05B 47/0045* (2013.01); *E05B 73/0017* (2013.01); *G07C 9/00* (2013.01); *G07C 9/00817* (2013.01); *G07C 9/00912* (2013.01); *G08B 13/1445* (2013.01); *G08B 13/1472* (2013.01); *G08B 13/2434* (2013.01); *G08B 25/008* (2013.01); *G08B 29/046* (2013.01);
(Continued)

(58) Field of Classification Search
CPC . E05B 45/06; E05B 73/0017; G08B 13/1445; G08B 13/2434; G08B 25/008; G08B 29/046
USPC ..... 340/568.1, 568.2, 568.8, 572.1, 693.5, 340/691.1, 815.45, 5.25, 5.21–5.23, 5.28, 340/5.6, 5.61, 5.64, 5.65, 10.51, 571, 543; 70/57.1, 344, 277, 58, 276
See application file for complete search history.

(56) References Cited

U.S. PATENT DOCUMENTS 2,932,538 A 4/1960 Holmes
3,427,834 A 2/1969 Tutino
(Continued)

*Primary Examiner* — Hoi Lau
(74) *Attorney, Agent, or Firm* — InVue Security Products Inc.

(57) ABSTRACT

A security device for an item of merchandise is provided. The security device includes a non-programmable locking mechanism comprising a mechanical lock and a programmable locking mechanism comprising a monitoring circuit operatively coupled to an alarm. The security device is configured to secure an item of merchandise from theft or removal when the mechanical lock is locked and to be separated from the item of merchandise when the mechanical lock is unlocked. The alarm is configured to provide an alarm signal if the security device is separated from the item of merchandise while the monitoring circuit is armed.

20 Claims, 7 Drawing Sheets

Related U.S. Application Data continuation of application No. 13/966,420, filed on Aug. 14, 2013, now Pat. No. 8,842,012, which is a continuation of application No. 12/685,780, filed on Jan. 12, 2010, now Pat. No. 8,542,119.

(60) Provisional application No. 61/144,298, filed on Jan. 13, 2009.

(51) Int. Cl.

| | |
|---|---|
| ***E05B 73/00*** | (2006.01) |
| ***G08B 29/04*** | (2006.01) |
| ***G08B 13/24*** | (2006.01) |
| ***E05B 19/04*** | (2006.01) |
| ***E05B 47/00*** | (2006.01) |
| ***G07C 9/00*** | (2006.01) |
| ***G08B 25/00*** | (2006.01) |

(52) U.S. Cl.

CPC ..... *G07C 9/00944* (2013.01); *Y10T 70/5004* (2015.04); *Y10T 70/5009* (2015.04); *Y10T 70/7057* (2015.04); *Y10T 70/7062* (2015.04); *Y10T 70/7486* (2015.04)

(56) References Cited

U.S. PATENT DOCUMENTS 3,566,636 A 3/1971 Rudolf et al.
3,672,192 A 6/1972 Donatas
4,022,038 A 5/1977 Miller
5,124,685 A 6/1992 Rankin
5,146,205 A 9/1992 Keifer et al.
5,680,094 A 10/1997 Guim et al.
5,861,807 A 1/1999 Leyden et al.
5,869,908 A * 2/1999 Moczygemba ..... B60R 25/24 180/287
6,227,020 B1 * 5/2001 Lerchner ..... E05B 17/147 70/278.3
6,420,971 B1 7/2002 Leck et al.
6,474,478 B1 11/2002 Huehner et al.
6,600,406 B1 7/2003 Ha
6,666,330 B2 12/2003 Sedon et al.
6,734,788 B1 5/2004 Winner
7,053,774 B2 5/2006 Sedon et al.
7,131,542 B2 11/2006 Sedon et al.
7,209,038 B1 * 4/2007 Deconinck ..... G08B 13/1409 340/541
7,221,274 B2 5/2007 Fawcett et al.
7,385,522 B2 6/2008 Belden, Jr. et al.
7,598,861 B2 10/2009 Belden, Jr. et al.
7,629,895 B2 12/2009 Belden, Jr. et al.
7,667,601 B2 2/2010 Rabinowitz et al.
7,737,843 B2 6/2010 Belden, Jr. et al.
7,737,844 B2 6/2010 Scott et al.
7,737,845 B2 6/2010 Fawcett et al.
7,737,846 B2 6/2010 Belden, Jr. et al.
7,961,100 B2 6/2011 Wyatt, Jr. et al.
7,969,305 B2 6/2011 Belden, Jr. et al.
8,341,987 B2 1/2013 Nagelski
8,368,536 B2 2/2013 Fawcett et al.
8,542,119 B2 9/2013 Sankey
8,842,012 B2 9/2014 Sankey
9,305,444 B2 * 4/2016 Sankey ..... E05B 19/046
2002/0109582 A1 * 8/2002 Mooney ..... H02J 7/0045 340/5.65
2003/0231131 A1 * 12/2003 Dimig ..... B60R 25/209 341/176
2004/0124969 A1 * 7/2004 Okada ..... B60R 25/24 340/5.72
2005/0073413 A1 * 4/2005 Sedon ..... A47F 7/024 340/568.8
2005/0099262 A1 5/2005 Childress et al.
2005/0159184 A1 7/2005 Kerner et al.
2006/0097875 A1 5/2006 Ott
2006/0137411 A1 6/2006 Fawcett et al.
2006/0145849 A1 7/2006 Fawcett et al.
2006/0170549 A1 * 8/2006 Belden, Jr. ..... A47F 5/0861 340/568.2
2006/0170550 A1 8/2006 Marsilio et al.
2007/0090921 A1 * 4/2007 Fisher ..... G07C 9/00103 340/5.73
2007/0120669 A1 5/2007 Belden, Jr.
2007/0144224 A1 6/2007 Scott et al.
2007/0146134 A1 * 6/2007 Belden ..... G08B 13/1445 340/571
2007/0152819 A1 7/2007 Marszalek et al.
2007/0152835 A1 7/2007 Marsilio et al.
2007/0159328 A1 7/2007 Belden et al.
2007/0171061 A1 7/2007 Belden et al.
2007/0194918 A1 8/2007 Rabinowitz et al.
2008/0012684 A1 * 1/2008 Fawcett ..... G07C 9/00309 340/5.25
2008/0168806 A1 7/2008 Belden et al.
2008/0168811 A1 7/2008 Nagelski
2008/0169923 A1 7/2008 Belden et al.
2008/0169924 A1 7/2008 Belden
2008/0236209 A1 10/2008 Conti et al.
2009/0033497 A1 2/2009 Wyatt, Jr. et al.
2010/0175438 A1 * 7/2010 Sankey ..... E05B 19/046 70/57.1
2010/0176945 A1 7/2010 Fawcett et al.
2010/0238031 A1 9/2010 Belden, Jr. et al.
2011/0254661 A1 10/2011 Fawcett et al.
2012/0047972 A1 3/2012 Grant et al.
2014/0118930 A1 * 5/2014 Sedon ..... E05B 73/0082 361/679.56
2014/0362517 A1 * 12/2014 Moock ..... E05B 73/0082 361/679.43
2015/0013398 A1 1/2015 Taylor et al.

* cited by examiner

COMBINATION NON-PROGRAMMABLE AND PROGRAMMABLE KEY FOR SECURITY DEVICE

CROSS REFERENCE TO RELATED APPLICATION

This non-provisional application is a continuation of U.S. application Ser. No. 14/454,111, filed on Aug. 7, 2014, which is a continuation of U.S. application Ser. No. 13/966,420, filed on Aug. 14, 2013, now U.S. Pat. No. 8,842,012, which is a continuation of U.S. application Ser. No. 12/685,780, filed on Jan. 12, 2010, now U.S. Pat. No. 8,542,119, which claims the benefit of priority of U.S. Provisional Application No. 61/144,298, filed on Jan. 13, 2009, each of which is incorporated herein by reference in its entirety.

BACKGROUND OF THE INVENTION

The present invention relates generally to a key for a security device or security packaging of the type commonly used to display an item of merchandise vulnerable to theft. More particularly, the invention relates to a combination non-programmable and programmable key for a merchandise security device.

It is common practice for retailers to display relatively small, relatively expensive items of merchandise on a security device, such as a display hook or a display fixture, or within security packaging commonly referred to as a "keeper." The security device or keeper displays an item of merchandise so that a potential purchaser may examine the item when deciding whether to purchase the item. The small size and relative expense of the item, however, makes the item an attractive target for shoplifters. A shoplifter may attempt to detach the item from the security device, or alternatively, may attempt to remove the security device from the display area along with the merchandise. Typically, the security device is attached to a display support, such as a pegboard, wire grid, horizontal bar rack, slatwall (also known as slatboard), wall, table, desk, countertop or other secure structure. In some instances, the security device is secured to the display support using a locking mechanism operated by a non-programmable key, for example a mechanical lock. In other instances, the security device is secured to the display support using a locking mechanism operated by a programmable key, for example a sensor and monitoring circuit operatively coupled to an alarm and responsive to an energy signal received from the programmable key to arm and disarm the alarm.

A mechanical lock operated by a non-programmable key is relatively inexpensive and can be made sufficiently strong to prevent the security device from being separated from the display support. However, non-programmable keys for mechanical locks are typically not unique. Therefore, each key operates the mechanical lock on every security device in the display area. As a result, all of the security devices are compromised if any one of the keys is stolen or duplicated. If each key is unique, or if there are multiple different keys, an authorized person must identify and locate the key matching the locking mechanism of a particular security device. This is time consuming and can result in a security device being unable to be unlocked until a replacement key is obtained if the matching key is lost or stolen. The mechanical lock may be a combination type locking mechanism having a predetermined, non-programmable combination. However, the aforementioned disadvantages exist for the same reasons regardless of whether the combination is the same for each locking mechanism, whether the combination is unique, or whether multiple different combinations are provided for several security devices.

A sensor or other locking mechanism operated by a programmable key has the advantage that each, several or all of the security devices and their corresponding keys can be programmed with an energy signal for arming and disarming an alarm, referred to herein as a security disarm code (SDC). The SDC is selected by the retailer and made known only to authorized persons. Accordingly, an unauthorized person without access to the SDC cannot program a duplicate key with the same SDC. Furthermore, the programmable keys and security devices can be readily re-programmed with a different SDC in the event that one of the programmable keys is lost or stolen. Alternatively, each programmable key and security device may be programmed with a random SDC that is unknown to any individual. A disadvantage of a sensor or other locking mechanism operated by a programmable key is that the locking mechanism does not physically attach the security device to the support. As a result, a shoplifter may physically detach the security device from the support and attempt to leave the display area before security personnel respond to the alarm. Another disadvantage is that store personnel are often preoccupied with selling the items of merchandise, and consequently, fail to arm the security devices or neglect to re-arm a security device that has been disarmed for any reason. A further disadvantage is that a security device operated by a programmable key may be inoperable in the event of a power outage or other electrical failure, and may be suspect to circumvention by an energy signal generated by a device other than an authentic key.

No known security device exists that is available with separate locking mechanisms operated by a combination non-programmable and programmable key. More particularly, there is no known security device available with both a locking mechanism operated by a non-programmable portion of a key for physically securing the security device to a display support and a locking mechanism operated by a programmable portion of the key for arming and disarming a monitoring circuit operatively coupled to an audible or visual alarm. Heretofore, manufacturers and retailers have not recognized the synergistic advantages provided by a security device having separate locking mechanisms operated by a combination key having a non-programmable portion and a programmable portion. Specifically, such a security device provides both the structural integrity of a locking mechanism that physically attaches the security device to a display support and the increased reliability provided by a locking mechanism operated by a programmable key to arm and disarm an alarm. Accordingly, there exists an unresolved need for a security device having separate locking mechanisms operated by a combination non-programmable and programmable key. There exists a further and more specific need for a combination non-programmable and programmable key for a security device or security packaging of the type commonly used to display an item of merchandise vulnerable to theft.

BRIEF DESCRIPTION OF THE DRAWINGS

The following detailed description of the invention is best understood with reference to the accompanying drawing figures.

DETAILED DESCRIPTION OF THE INVENTION

Figure 1:
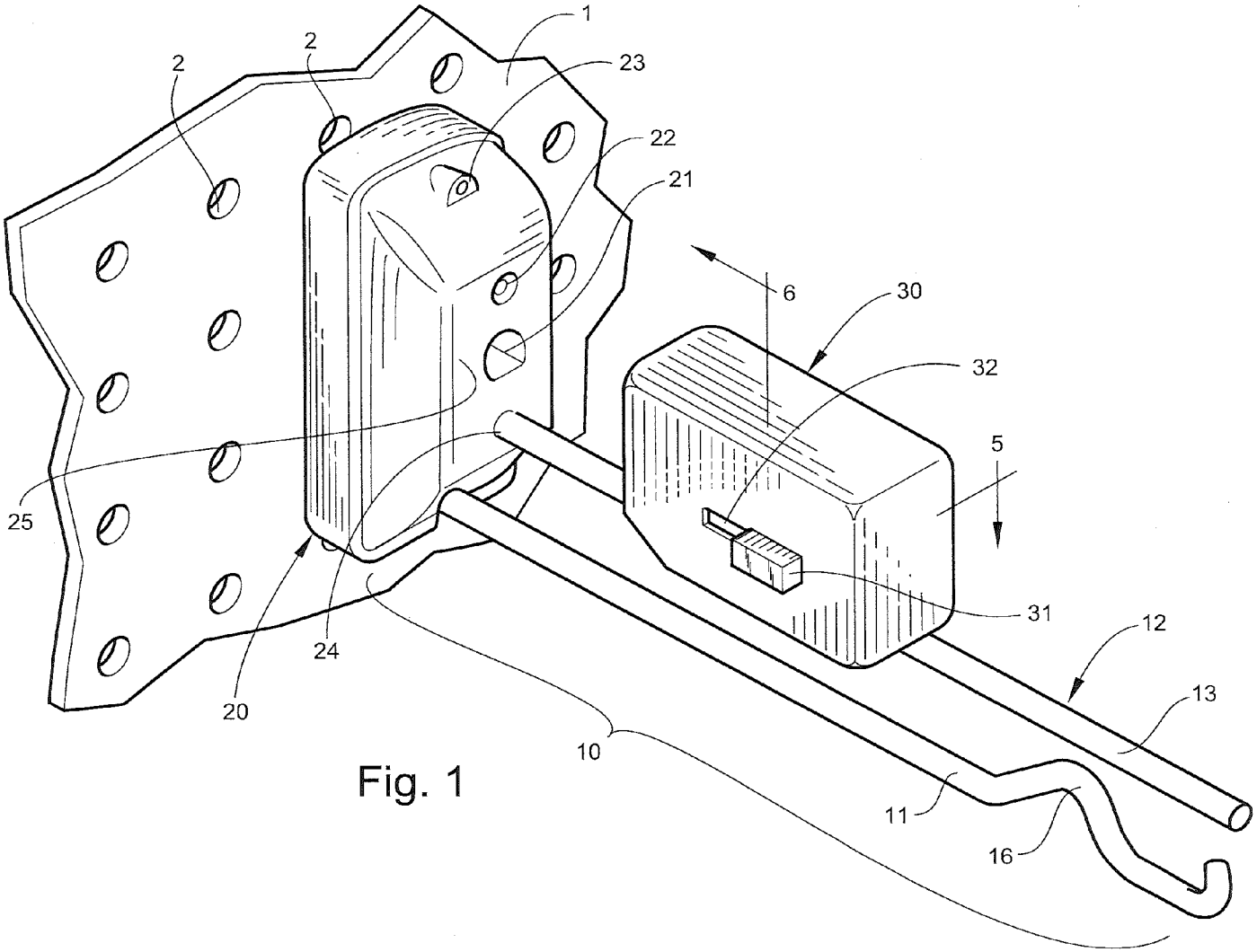
FIG. 1 is a front perspective view of a security device of the type commonly used to display an item of merchandise configured for use with a combination non-programmable and programmable key according to the present invention.

Referring now to the accompanying drawing figures wherein like reference numerals denote like elements throughout the various views, one or more exemplary embodiments of a security device, indicated generally at 10, and a combination non-programmable and programmable key, indicated generally at 30, according to the present invention are shown. The security device 10 is of the type commonly used to display one or more items of merchandise (not shown for purposes of clarity) within a display area of a retail store. By way of example, and not by limitation, the security device shown and described herein is a merchandise display hook for displaying relatively, small, relatively expensive consumer products, for example compact discs (CDs), digital video discs (DVDs), battery packs, etc., on a display support 1. Other examples of a security device according to the present invention without limitation include merchandise display fixtures and merchandise keepers. As shown, the merchandise display hook 10 is configured for mounting onto a conventional pegboard type display support 1 in a known manner.

As best shown in FIGS. 1-4, the display hook 10 comprises a rod assembly 12 having mounting structure disposed at one end for mounting the display hook onto the pegboard 1. In particular, the rod assembly 12 has at least one, and preferably, a pair of mounting prongs 14 (FIG. 3) at one end operable for engaging horizontally and/or vertically spaced apertures 2 formed through the pegboard 1. It should be noted that mounting prongs 14 may take the form of pegs, hooks, tabs, extensions, or any other structure suitable for engaging the spaced-apart apertures 2 provided on the pegboard 1, or for engaging suitable openings provided on a conversion bracket for attaching the display hook 10 to another type of display support, such as wire grid, horizontal bar rack, slatwall (also known as slatboard), wall, table, desk, countertop or other secure structure.

As shown herein, the rod assembly 12 comprises a lower support rod 11 for supporting one or more items of merchandise and an upper guide rod 13 for positioning an optional label holder (not shown) on the free end of the rod assembly opposite the mounting prongs 14. As is known in the art, the label holder may be configured to be lockable on the rod assembly 12 (i.e. guide rod 13 and/or support rod 11) to prevent the items of merchandise from being removed by an unauthorized person. As is also known, the support rod 11 may be provided with an optional anti-sweep feature 16 adjacent the free end of the rod assembly 12. The anti-sweep feature 16 shown herein comprises a series of bends along support rod 11 through which an item of merchandise must be manipulated in order to remove the item from the display hook 10. However, the anti-sweep feature 16 is not intended to be limited to the configuration shown and described herein. Instead, the anti-sweep feature 16 may comprise any structure and may take any form suitable for increasing the time required to remove one or more of the items of merchandise from the display hook 10. For example, the anti-sweep feature 16 may comprise a time delay mechanism configured to require the items of merchandise to be removed in limited quantities, such as individually.

Regardless, the display hook 10 comprises a locking base 20 disposed on the rod assembly 12 adjacent the pegboard 1. As will be described in greater detail, the locking base 20 is slidably disposed on the rod assembly 12. Upper guide rod 13 is sized and positioned to be received within an opening 24 formed through the locking base 20. A recess 21 having a predetermined shape is formed in a front face 25 of the locking base 20. The recess 21 is sized and shaped to receive a component of the non-programmable portion of the key 30. The key 30 is configured to unlock the locking base 20, as will be described, and thereby permit the locking base to slide on the rod assembly 12. Specifically, the locking base 20 may be slid from the locked position shown in FIG. 1 and FIG. 2 along the guide rod 13 in a direction away from the mounting prongs 14 and towards the free end of the guide rod. Consequently, the locking base 20 is operable for securely locking the display hook 10 onto the pegboard 1 and for being unlocked relative to the rod assembly 12 and moved outwardly along the guide rod 13 to permit the display hook to be removed from the pegboard. In the exemplary embodiment shown and described herein, the display hook 10 is positioned on the pegboard 1 and the locking base 20 is then slid along the rod assembly 12 in the direction of the pegboard and secured in place by a locking pin 60 (FIG. 2) that is biased downwardly by a spring 61

Figure 2:
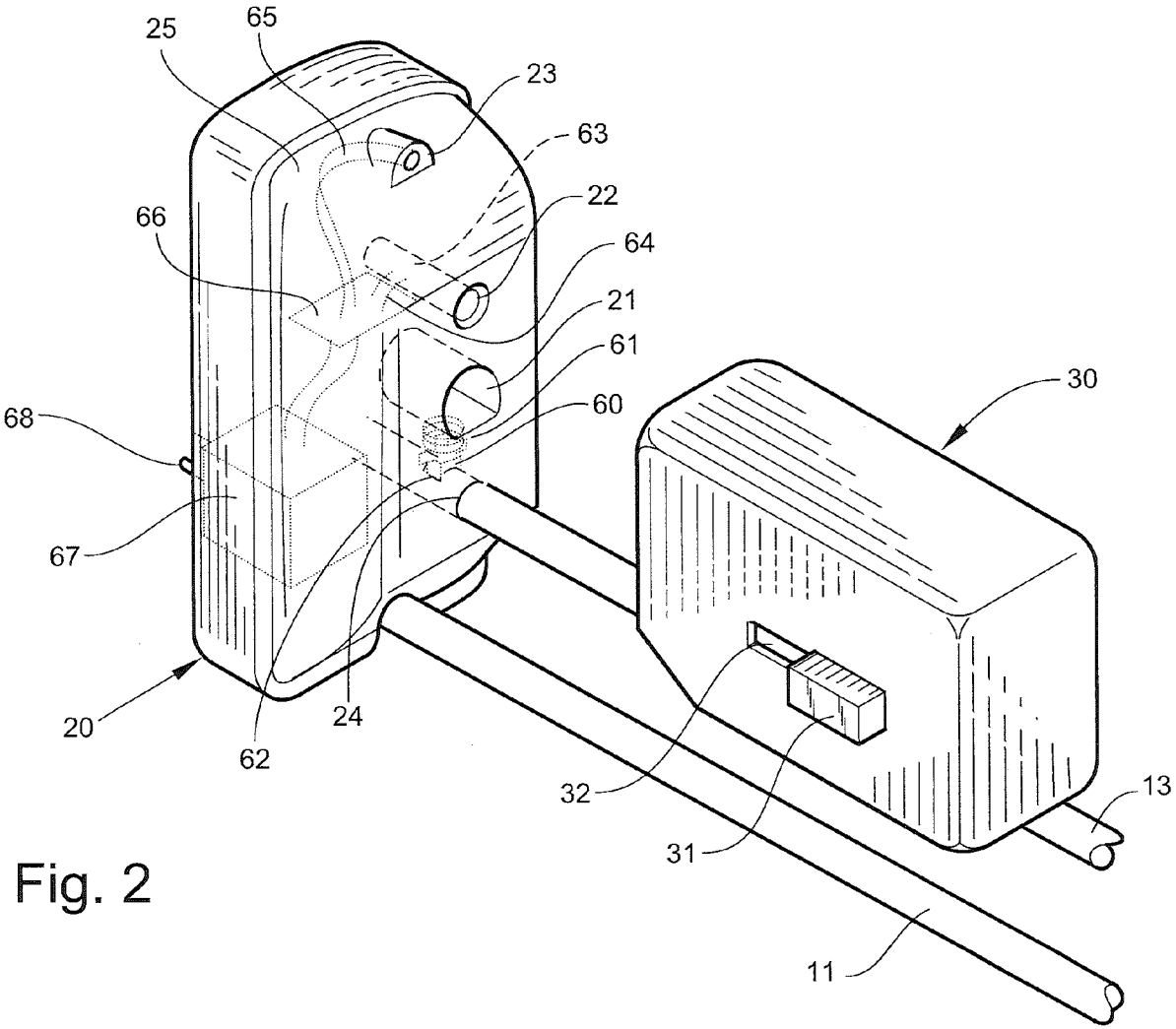
FIG. 2 is a front perspective view showing a locking base of the security device of FIG. 1 in greater detail.
Figure 3:
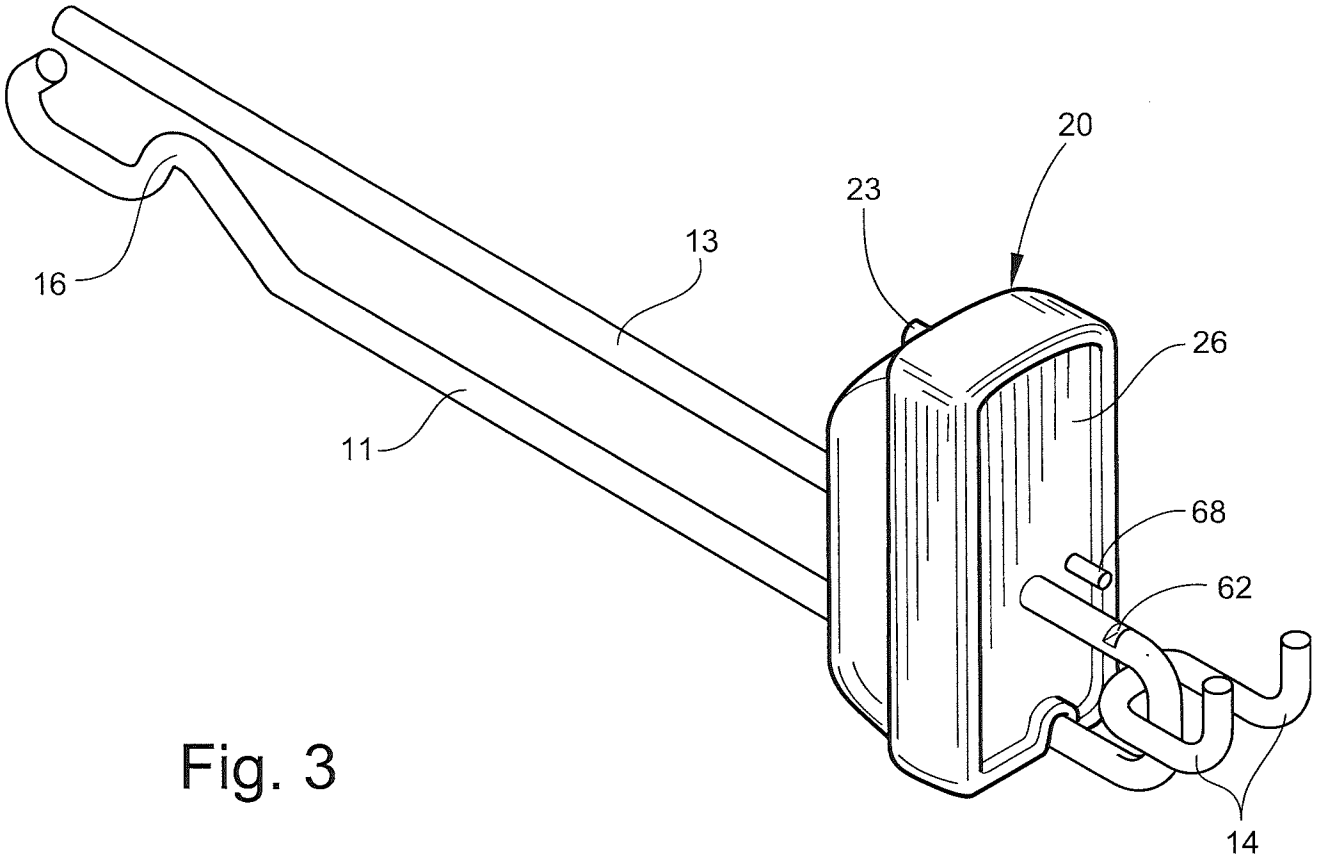
FIG. 3 is a rear perspective view of the security device of FIG. 1.
Figure 4:
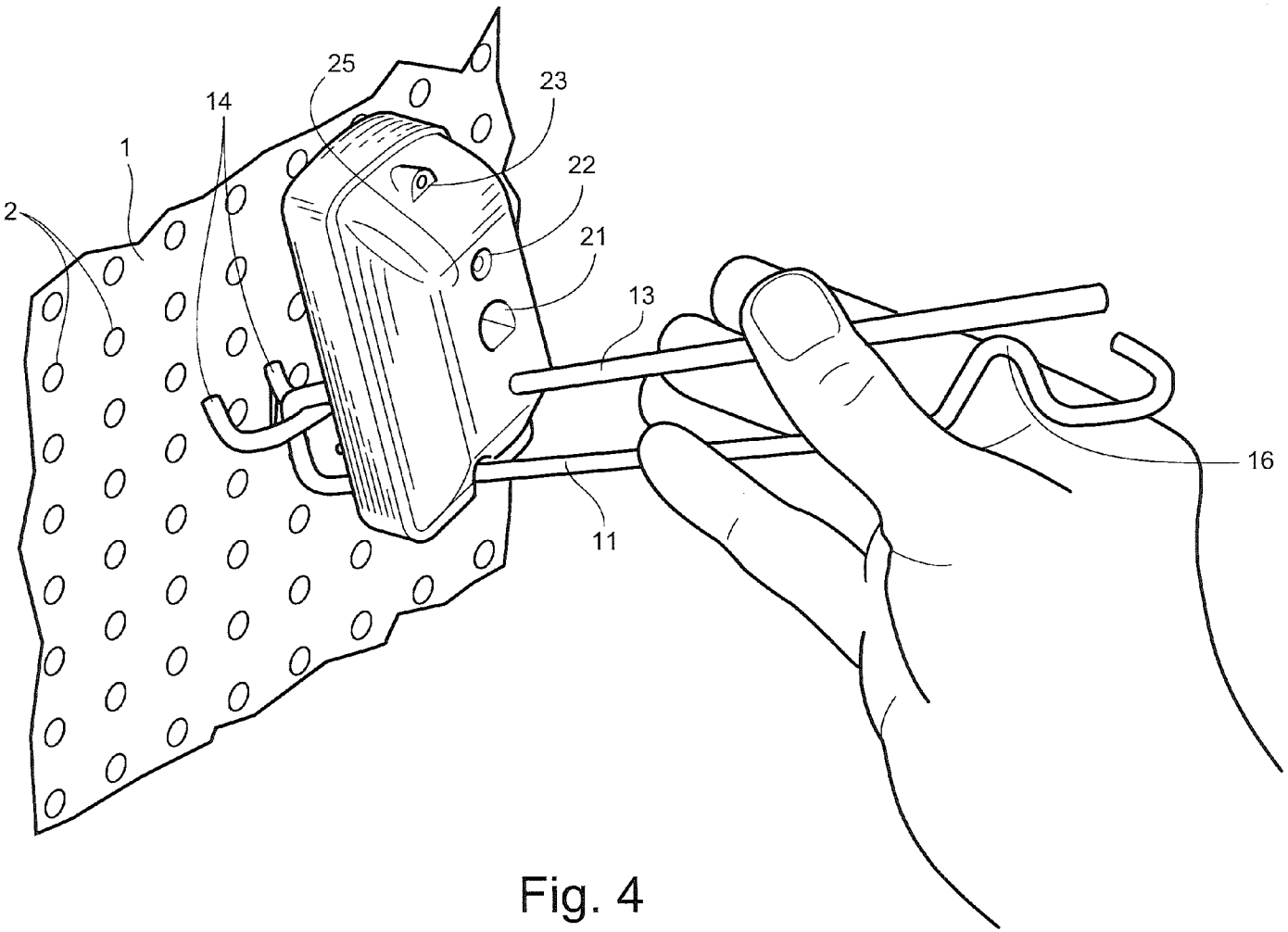
FIG. 4 is a front perspective view illustrating the security device of FIG. 1 being attached to a pegboard type display support.

(FIG. 2) into a notch 62 (FIG. 2; FIG. 3) formed in the upper surface of the guide rod 13. The non-programmable portion of the key 30 is operable to unlock the locking base 20 from the rod assembly 12, as will be described with reference to FIG. 8C.

As illustrated by the exemplary embodiment shown herein, the recess 21 of the locking base 20 has a predetermined size and shape configured to receive a corresponding sized and shaped component of the non-programmable portion of the key 30. As will be described in greater detail hereafter, the non-programmable portion of the key 30 is configured to be received within the recess 21 of the locking base 20 to withdraw the locking pin 60 out of the notch 62 against the biasing force of the spring 61. In the exemplary embodiment, the locking pin 60 is made of a magnetic or magnetized (i.e. magnetically attractable) material and the non-programmable portion of the key 30 is a magnet 50 (see FIG. 5; FIG. 6). An inlet port 22 for receiving an energy signal is also formed in the locking base 20 and is shown positioned above the recess 21. The inlet port 22 is configured to receive an energy signal emitted from the programmable portion of the combination non-programmable and programmable key 30. The inlet port 22 may be configured to receive any type of energy signal, for example, electrical, optical, acoustical, wireless, or magnetic pulse. A suitable energy signal inlet port 22 is an infrared sensor of the type shown and described in the commonly owned U.S. patent application Ser. No. 11/638,861 entitled "Programming Station For A Security System For Protecting Merchandise," the disclosure of which is incorporated herein by reference. The inlet port 22 of the infrared sensor includes a light pipe 63 for channeling an infrared signal and is in electrical communication via one or more optical/electrical conductors 64 to a printed circuit board (PCB) 66 operatively coupled to an audible or visual alarm (not shown). The programmable portion of the key 30 is operable to emit the infrared signal into the light pipe 63 to arm and disarm the alarm in a known manner, as will be described with reference to with reference to FIG. 8B.

Locking base 20 further comprises a sensor 67 having an extensible proximity (e.g. contact; limit; etc.) switch 68 that is positioned on a rear face 26 (FIG. 3) of the locking base and is in electrical communication via one or more conductors 65 with PCB 66. The proximity switch 68 indicates contact between the locking base 20 of the display hook 10 and the pegboard 1 by retraction of the proximity switch into the sensor 67 and indicates separation between the locking base and the pegboard by extension of the proximity switch out of the sensor. A suitable sensor 67 and proximity switch 68 are shown and described in the commonly owned U.S. patent application Ser. No. 11/638,727 entitled "Programmable Alarm Module And System For Protecting Merchandise," the disclosure of which is incorporated herein by reference. Locking base 20 further comprises a conventional light-emitting diode (LED) indicator 23 that is positioned on an exterior surface of the locking base and is in electrical communication via one or more conductors 65 with PCB 66. The LED indicator 23 is operable to alert an authorized person as to the status of the locking base 20, for example whether the alarm is armed or disarmed and/or whether the proximity switch 68 is retracted or extended. In one example, the LED indicator 23 is illuminated when the proximity switch 68 is retracted and the alarm is armed, and is not illuminated when the alarm is disarmed. Alternatively, the LED indicator 23 may be illuminated with a red colored light when the alarm is armed and illuminated with a green colored light when the alarm is disarmed.

Figure 5:
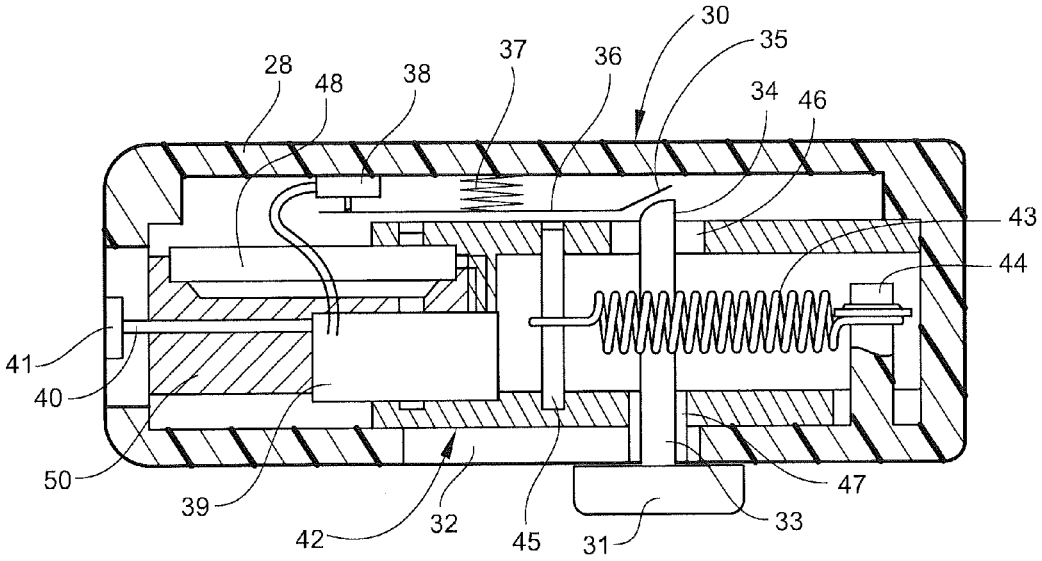
FIG. 5 is a lateral cross-sectional view of the combination non-programmable and programmable key taken at the location indicated in FIG. 1.
Figure 6:
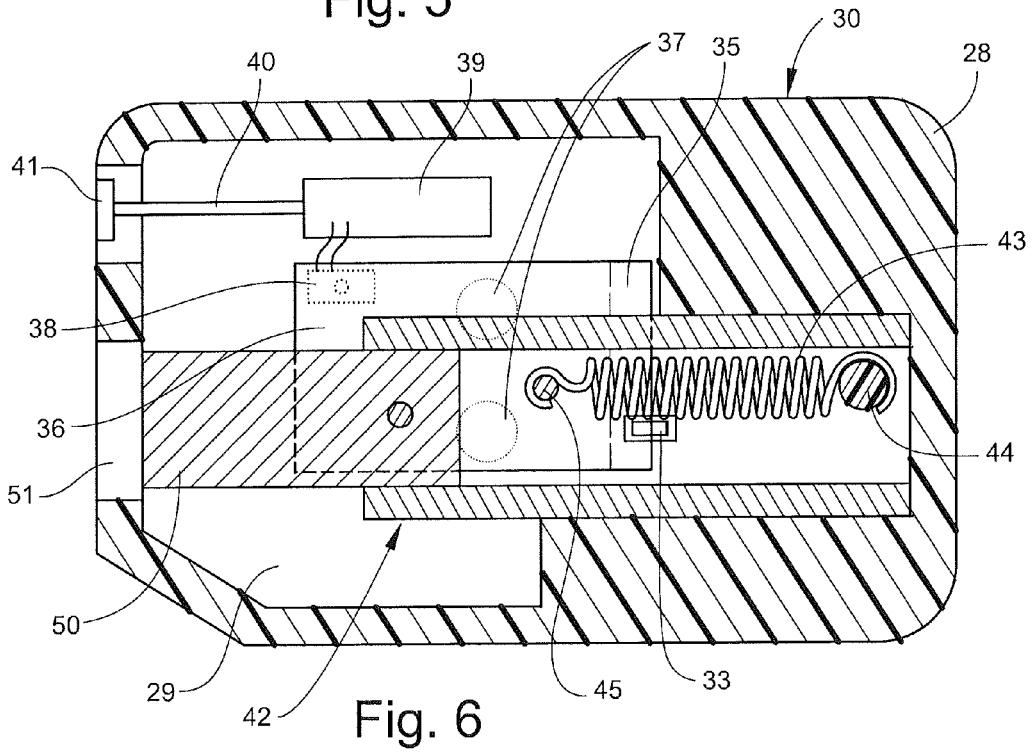
FIG. 6 is a longitudinal cross-sectional view of the combination non-programmable and programmable key taken at the location indicated in FIG. 1.

The combination non-programmable and programmable key 30 is best shown in FIG. 5 and FIG. 6. The sequential operation of the key 30 to arm/disarm the alarm and to unlock the locking base 20 from the rod assembly 12 of the display hook 10 is illustrated in FIGS. 7A-7C and FIGS. 8A-8C. The key 30 comprises a housing 28 defining an interior cavity 29 that is sized and shaped to accommodate the internal components of the key 30. The exemplary embodiment of the key 30 shown and described herein is specially designed for use with the merchandise display hook type of security device depicted herein. It will be readily apparent to those skilled in the art that the key 30 may have any desirable size and shape suitable for use with one or more security devices having both a non-programmable locking mechanism and a programmable locking mechanism. As used herein, the term "locking mechanism" is intended to be construed broadly and thereby encompass, by way of example and not by limitation, an alarm system for monitoring the status of the security device wherein arming the alarm system corresponds to a locked status and disarming the alarm system corresponds to an unlocked status.

A key 30 of the present invention is similar in certain respects to the security key having only a programmable portion shown and described in commonly owned U.S. patent application Ser. No. 11/639,100 "Programmable Key For A Security System For Protecting Merchandise," the disclosure of which is incorporated herein by reference. The key 30 comprises a finger-operated button 31 having a button stem 33 that is adapted to be received within a longitudinally extending elongate channel 32 formed through the exterior of the housing 28. The button stem 33 has a cam surface 34 at its free end opposite the button 31 for engaging an electrically conducting contact strip 36. The contact strip 36 is provided with an angled ramp portion 35 at one end to permit the cam surface 34 to smoothly engage and disengage from the contact strip. The contact strip 36 is adapted to open and close a contact switch 38 and is biased away from the contact switch by a biasing member 37, for example one or more coils springs 37. As shown, the contact switch 38 is open in an extended position and is closed in a retracted position.

The contact switch 38 is electrically connected to an energy signal module 39 configured to emit an energy signal. In the exemplary embodiment depicted herein, the energy signal module 39 is configured to emit an infrared signal through a light pipe 40 to an outlet port 41. A conventional battery 48 is disposed within the housing 28 of the key 30 to provide sufficient power to the energy signal module 39 for emitting the infrared signal to the outlet port 41 via the light pipe 40. Generally, the programmable portion of the key 30 is operable to cause the energy signal module 39 to generate and emit an infrared signal that communicates with the inlet port 22 of an infrared sensor to arm/disarm the alarm operatively coupled to the PCB 66, or alternatively, to activate/deactivate the proximity switch 68. The PCB 66 within the locking base 20 may be configured to disarm the alarm (or to deactivate the proximity switch 68) until rearmed (or reactivated). Alternatively, PCB 66 may be configured to disarm the alarm (or to deactivate the proximity switch 68) for a predetermined period of time deemed sufficient to remove the display hook 10 from the pegboard 1 and to reposition the display hook at another location on the pegboard.

The combination non-programmable and programmable key 30 further comprises a slide assembly 42 that is movably disposed within the interior cavity 29 of the housing 28. The slide assembly 42 includes a first opening 46 and a second opening 47 that receive the button stem 33. A stationary anchor post 44 provided on the housing 28 is not movable with the slide assembly 42 such that the anchor post 44 remains in the same position regardless of the position of the slide assembly 42. Slide assembly 42 further includes a laterally extending pin 45 and a spring 43 having opposed ends that are attached to the anchor post 44 and the pin 45 such that spring 43 acts to bias slide assembly 42 in a retracted position within the housing 28. Movement of the button 31 in a forward direction causes button stem 33 to impart an extension force on the slide assembly 42 counter to the biasing force of the spring 43. As a result of the movement of slide assembly 42, a magnet 50 fixed on an end of the slide assembly opposite the spring 43 is extended outwardly through an opening 51 formed in the housing 28. When the button 31 is released (or is returned to its original position), the biasing force of the spring 43 pulls the slide assembly 42 in a rearward direction within the housing 28, and consequently, retracts the magnet 50 through the opening 51 back into the housing 28 to a retracted position.

Figure 7A:
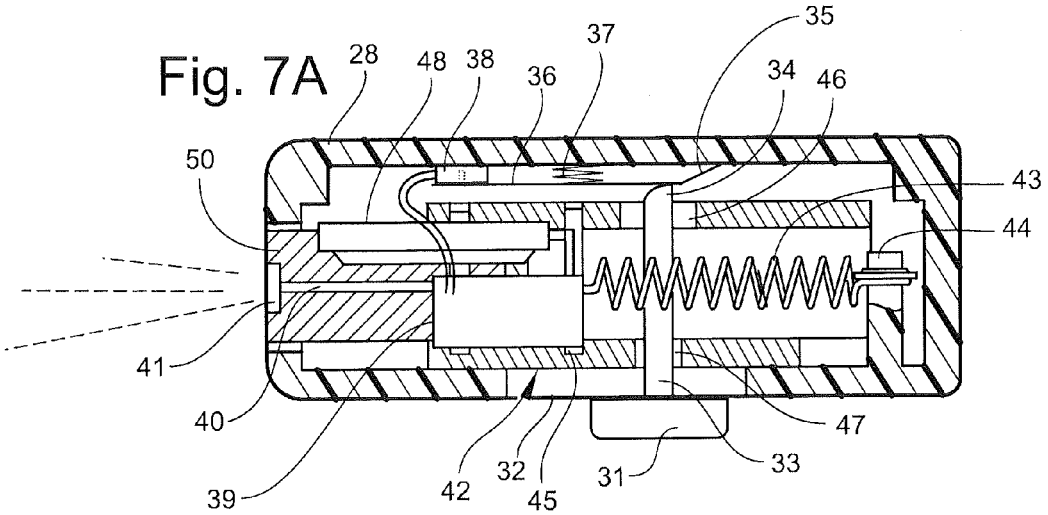
FIG. 7A is a lateral cross-sectional view of the combination non-programmable and programmable key illustrating the key in a first sequential operation wherein an energy signal of the programmable portion of the key is emitted.
Figure 7B:
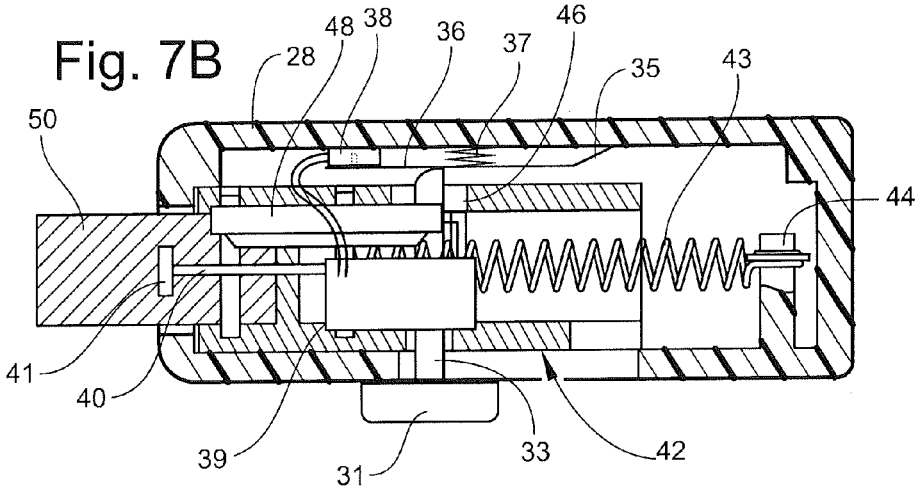
FIG. 7B is a lateral cross-sectional view of the combination non-programmable and programmable key illustrating the key in a second sequential operation wherein a magnet of the non-programmable portion of the key is in an extended position.
Figure 7C:
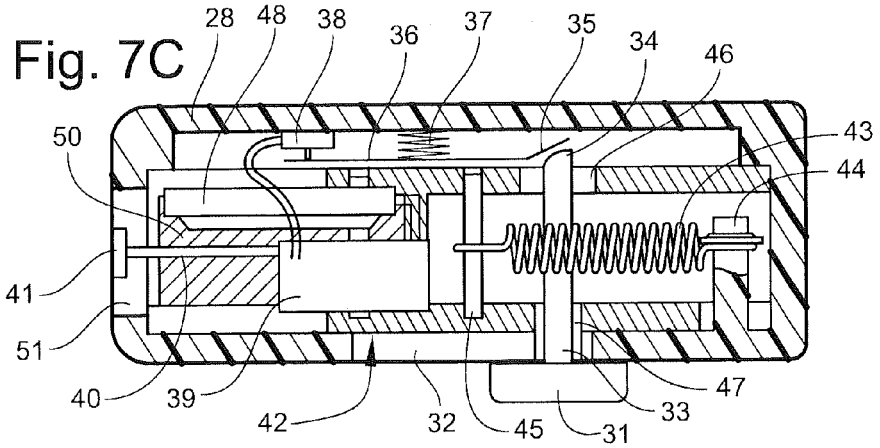
FIG. 7C is a lateral cross-sectional view of the combination non-programmable and programmable key illustrating the key in a third sequential operation wherein the magnet of the non-programmable portion of the key is in a retracted position.
Figure 8A:
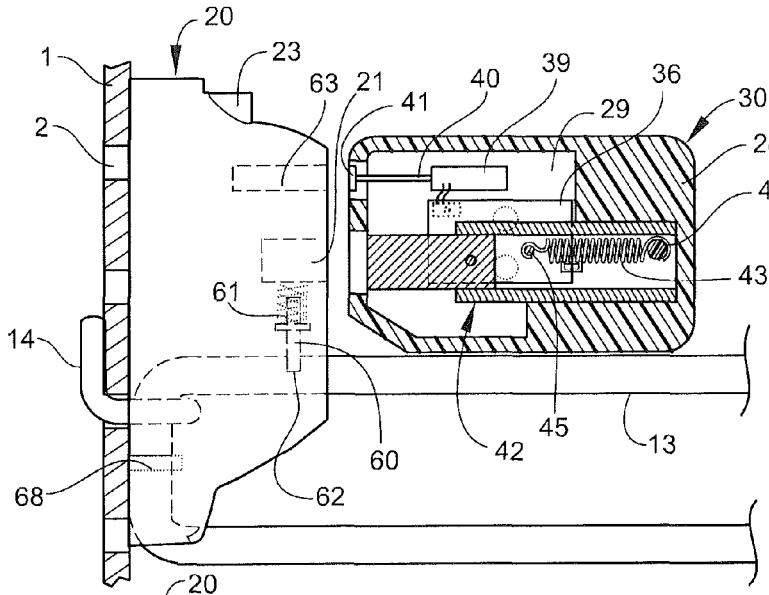
FIG. 8A is a longitudinal cross-sectional view of the security device and the combination non-programmable and programmable key illustrating the key positioned proximate the locking base of the security device with the magnet of the non-programmable portion of the key in the retracted position.
Figure 8B:
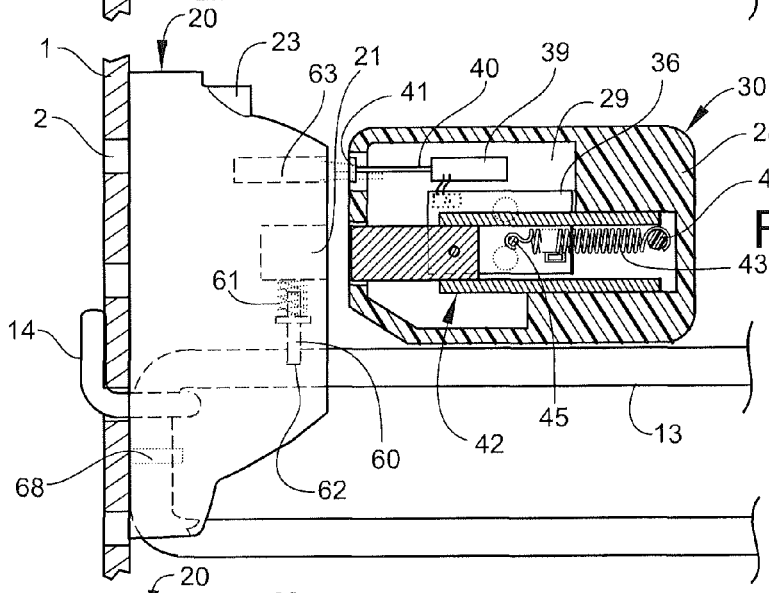
FIG. 8B is a longitudinal cross-sectional view of the security device and the combination non-programmable and programmable key illustrating the key positioned proximate the locking base of the security device with the energy signal of the programmable portion of the key emitted to disarm the alarm of the security device.
Figure 8C:
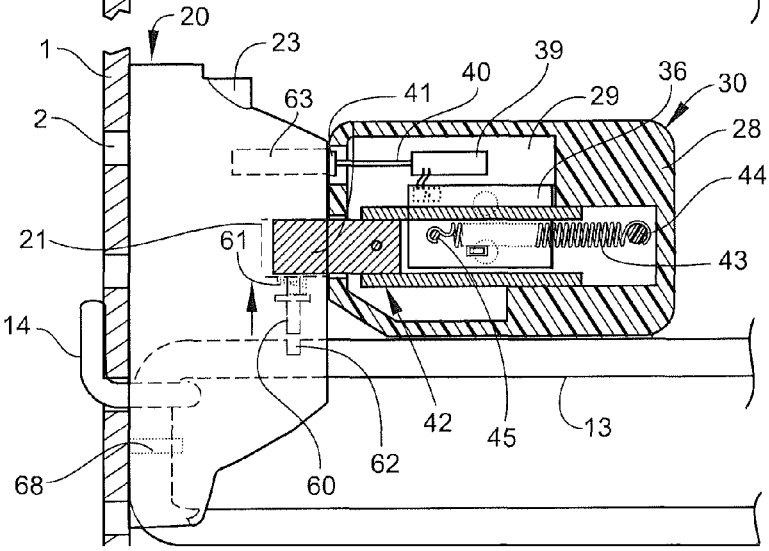
FIG. 8C is a longitudinal cross-sectional view of the security device and the combination non-programmable and programmable key illustrating the key positioned proximate the locking base of the security device with the magnet of the non-programmable portion of the key in the extended position to unlock the locking base.

The sequential operation of the combination non-programmable and programmable key 30 in conjunction with the display hook 10 and a pegboard type display support 1 is illustrated in the lateral cross-sectional views of FIGS. 7A-7C and in the longitudinal cross-sectional views of FIGS. 8A-8C. In an initial configuration illustrated in FIG. 8A, the key 30 is positioned proximate the locking base 20 with the display hook 10 locked onto the pegboard 1 and with the alarm operatively coupled to the PCB 66 armed. The LED indicator 23 is illuminated in the initial configuration to advise authorized personnel that the proximity switch 68 is retracted (i.e. closed) and the alarm is armed. As a result, the alarm will be activated if the proximity switch 68 is extended (i.e. opened), for example in the event that the locking base 20 of the display hook 10 is separated from the pegboard 1. It should be noted that the locking pin 60 of the locking base 20 is biased by the spring 61 into engagement with the notch 62 on the upper surface of the guide rod 13 so that the locking base cannot slide along the rod assembly 12. Furthermore, the slide assembly 42, and consequently, magnet 50 are in the retracted position within the housing 28 of the key 30.

In a first step illustrated in FIG. 8B and FIG. 7A, the combination non-programmable and programmable key 30 is positioned proximate the locking base 20 of the display hook 10. It should be noted that outlet port 41 and magnet 50 of key 30 are coaxially aligned with the inlet port 22 and the recess 21, respectively, of the locking base 20 such that when the key 30 is positioned on guide rod 13 opposite locking base 20, outlet port 41 is generally aligned with the inlet port 22 of the infrared sensor and magnet 50 is generally aligned with recess 21 associated with locking pin 60 and spring 61. Button 31 is advanced (i.e. slid) in the direction of the locking base 20 a predetermined distance sufficient to cause the cam surface 34 of the button stem 33 to engage the angled ramp portion 35 of contact strip 36 (FIG. 7A). As a result, the force applied to the contact strip 36 by the button stem 33 overcomes the biasing force of the biasing member(s) 37 to retract (close) the contact switch 38. When the contact switch 38 is closed, the energy signal module 39 of the programmable portion of the key 30 generates an infrared signal that is emitted along light pipe 40 and through the outlet port 41, as indicated by broken lines in FIG. 7A. With the outlet port 41 positioned adjacent the inlet port 22 of the infrared sensor, the infrared signal is received within the light pipe 63 of the locking base 20 (FIG. 8B). As a result, the PCB 66 disarms the alarm so that the alarm will not be activated if the proximity switch 68 moves from the retracted position to the extended position, for example when the locking base 20 of the display hook 10 is separated from the pegboard 1. It should be noted that in the configuration illustrated in FIG. 7A and FIG. 8B, the magnet 50 is moved adjacent to the opening 51 of housing 28, but is not yet extended outwardly from the housing.

In a next step illustrated in FIG. 7B and FIG. 8C, the combination non-programmable and programmable key 30 remains positioned on the guide rod 13 opposite the locking base 20 of the display hook 10. Button 31 is further advanced (i.e. slid) in the direction of the locking base 20 so that the slide assembly 42 moves the magnet 50 of the non-programmable portion of the key 30 out of the housing 28 through the opening 51 and into the recess 21 formed in the locking base (FIG. 8C). As a result, an attraction force between the magnet 50 and the locking pin 60 is generated that urges the locking pin 60 against the biasing force of the spring 61 and out of engagement with the notch 62 formed in the upper surface of the guide rod 13 (FIG. 8C). The operation of slide assembly 42 and magnet 50 is shown and described in greater detail in the commonly owned U.S. patent application Ser. No. 11/968,680 entitled "Magnetic Key For Use With A Security Device," the disclosure of which is incorporated herein by reference. With the locking pin 60 disengaged from the guide rod 13, the locking base 20 is movable (i.e. slidable) along the rod assembly 12 towards the free end of the guide rod 13 so that the display hook 10 can be removed from the pegboard 1. Although the locking base 20 is separated from the pegboard 1, and consequently, the proximity switch 68 is extended, the alarm is not activated since the programmable portion of the key 30 previously disarmed the alarm. It should be noted in FIG. 7B that during movement of the magnet 50 out of the housing 28 to the extended position, as well as during the majority of the movement of the magnet 50 back into the housing 28 to the retracted position, the button stem 33 of the button 31 remains engaged with the contact strip 36. The energy signal module 39, however, preferably does not emit the infrared signal once the magnet 50 extends outwardly from the housing 28. Instead, the energy signal module 39 is configured to emit the infrared signal upon initial retraction (closing) of the contact switch 38 and is prevented from emitting the infrared signal again until the magnet 50 is moved back into the housing 28 to the fully retracted position (FIG. 7C) and the contact switch 38 is again extended (opened).

In a final step illustrated in FIG. 7C, the combination non-programmable and programmable key 30 is positioned in the initial configuration once again by releasing or moving the button 31 in the rearward direction away from the locking base 20 so that the magnet 50 remains retracted into the housing 28 by the biasing force of the spring 43. With the key 30 returned to the initial configuration, the button stem 33 is out of engagement with the contact strip 36 and the contact switch 38 is extended (opened). The alarm operatively coupled to the PCB 66 may be configured to automatically re-arm following a predetermined lapse of time, provided that the proximity switch 68 is retracted (i.e. depressed) indicating that the locking base 20 is locked on the display hook 10 and secured against the pegboard 1, as previously described. Alternatively, the programmable portion of the key 30 may be used to re-arm the alarm. More specifically, the button 31 may be advanced in the forward direction sufficiently to cause the energy signal module 39 to emit the infrared signal without extending the magnet 50 outwardly from the housing 28 an amount sufficient to unlock the locking base 20 from the guide rod 13.

One of ordinary skill in the art will readily recognize that the particular order of the steps described above provides a desirable sequence of events. The combination non-programmable and programmable key 30 permits an authorized person to quickly and readily disarm a locking mechanism operated by a programmable key immediately prior to unlocking a locking mechanism operated by a non-programmable key. In this manner, the locking mechanism operated by the programmable key will not be activated in the event that the locking mechanism operated by the non-programmable key is unlocked and the security device (or the merchandise) is removed by an authorized person in possession of an authentic key 30. Conversely, if the programmable locking mechanism is not first disarmed by an authentic key 30, as described herein, the proximity switch 68 will activate the alarm as the non-programmable locking mechanism is unlocked. As a result, a combination non-programmable and programmable key constructed in accordance with the present invention provides the physical security of a non-programmable locking mechanism (e.g. a mechanical lock) with the customization and reliability of a programmable locking mechanism (e.g. a sensor and monitoring circuit operatively coupled to an alarm). It should be noted that the type of locking devices may be interchanged or operated in a reverse order as described herein as long as the alarm function of the security device is disarmed prior to the security device being unlocked from the display support, or the merchandise being unlocked from the security device. It should also be noted that a shoplifter or other unauthorized person not in possession of a programmable key having the proper SDC will necessarily activate the alarm of the security device even if he or she is in possession of an original, duplicate or counterfeit non-programmable key.

The foregoing has described one or more exemplary embodiments of a combination non-programmable and programmable key for a security device or security packaging of the type commonly used to display an item of merchandise. In the exemplary embodiments shown and described herein, the security device is a merchandise display hook configured for mounting on a pegboard type display support. However, the security device may be any type and take any form (e.g. merchandise display fixture; merchandise display stand; merchandise keeper; merchandise dispenser; etc) that includes both a non-programmable locking mechanism and a programmable locking mechanism. Furthermore, as used herein the term "locking mechanism" should be broadly construed to include any device, mechanism or feature that physically locks, secures or protects an item of merchandise from theft or removal, including without limitation a sensor and monitoring circuit operatively coupled to an alarm that produces an audible or visible alarm signal in the event that the item of merchandise is separated from or displaced relative to the display hook, fixture, stand, keeper or dispenser. Furthermore, each of the non-programmable and programmable locking mechanisms may be mechanical, electrical, optical (e.g. IR), acoustical (e.g. ultrasonic), wireless (e.g. RF), or magnetic pulse without departing from the spirit and scope of the present invention.

That which is claimed is:

1. A security device for an item of merchandise, the security device comprising:

a mechanical lock configured to be unlocked by a key; and a monitoring circuit operatively coupled to an alarm, wherein the monitoring circuit comprises a security code and wherein the monitoring circuit is configured to be disarmed in response to the security code matching a security code stored on the key, wherein the security device is configured to secure an item of merchandise from theft or removal when the mechanical lock is locked and the item of merchandise is configured to be removed from the security device when the mechanical lock is unlocked, wherein the alarm is configured to provide an alarm signal if the item of merchandise is removed from the security device while the monitoring circuit is armed and prior to disarming the monitoring circuit with the key.

2. The security device of claim 1, wherein the alarm is configured to provide an alarm signal if the mechanical lock is unlocked and the monitoring circuit is armed.

3. The security device of claim 1, further comprising a sensor configured to detect removal of the security device from the item of merchandise.

4. The security device of claim 3, wherein the sensor comprises a proximity switch.

5. The security device of claim 1, wherein the monitoring circuit is configured to be armed or disarmed by the key.

6. The security device of claim 1, wherein the monitoring circuit is configured to receive a wireless signal for disarming the monitoring circuit.

7. The security device of claim 1, wherein the monitoring circuit is configured to receive an energy signal for arming or disarming the monitoring circuit.

8. The security device of claim 7, wherein the energy signal is selected from the group consisting of an electrical signal, an optical signal, an acoustical signal, and a magnetic pulse signal.

9. The security device of claim 1, wherein the monitoring circuit is configured to receive an infrared signal for arming or disarming the monitoring circuit.

10. The security device of claim 1, wherein the mechanical lock comprises a magnetically attractable material.

11. The security device of claim 1, wherein the security device comprises one of a merchandise display fixture, a merchandise display stand, a merchandise keeper, or a merchandise display hook.

12. A security device for an item of merchandise, the security device comprising:

a mechanical lock configured to be unlocked by a key; and a monitoring circuit operatively coupled to an alarm, wherein the monitoring circuit comprises a security code and wherein the monitoring circuit is configured to be disarmed in response to the security code matching a security code stored on the key, wherein the security device is configured to secure an item of merchandise from theft or removal when the mechanical lock is locked and the item of merchandise is configured to be removed from the security device when the mechanical lock is unlocked, wherein the alarm is configured to provide an alarm signal if the item of merchandise is removed from the security device while the monitoring circuit is armed.

13. A method for securing an item of merchandise from theft, the method comprising:

locking a mechanical lock of a security device to secure an item of merchandise from theft or removal;

unlocking the mechanical lock of the security device with a key;

disarming a monitoring circuit of the security device in response to a security code of the monitoring circuit matching a security code of the key, the monitoring circuit operatively coupled to an alarm; and removing the item of merchandise from the security device when the mechanical lock is unlocked.

14. The method of claim 13, wherein removing the item of merchandise comprises removing the item of merchandise from the security device after the monitoring circuit is disarmed by the key.

15. The method of claim 13, wherein disarming comprises actuating the key for emitting a wireless signal.

16. The method of claim 13, wherein the key comprises a magnet, and wherein unlocking comprises engaging the magnet with the mechanical lock.

17. The method of claim 13, wherein the alarm is configured to provide an alarm signal if the security device is removed from the item of merchandise when the monitoring circuit is armed.

18. The security device of claim 1, wherein the security code is randomly generated.

19. The security device of claim 12, wherein the security code is randomly generated.

20. The method of claim 13, wherein the security code is randomly generated.

* * * * *